US011837397B2

(12) United States Patent
Tanaka et al.

(10) Patent No.: US 11,837,397 B2
(45) Date of Patent: Dec. 5, 2023

(54) WIRE-WOUND INDUCTOR COMPONENT

(71) Applicant: Murata Manufacturing Co., Ltd., Kyoto-fu (JP)

(72) Inventors: Akira Tanaka, Nagaokakyo (JP); Sunao Noya, Nagaokakyo (JP); Tomotaka Gotohda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 531 days.

(21) Appl. No.: 16/891,777

(22) Filed: Jun. 3, 2020

(65) Prior Publication Data

US 2020/0402703 A1 Dec. 24, 2020

(30) Foreign Application Priority Data

Jun. 21, 2019 (JP) ..... 2019-115388

(51) Int. Cl.
*H01F 27/28* (2006.01)
*H01F 27/29* (2006.01)
(Continued)

(52) U.S. Cl.
CPC ..... *H01F 27/2823* (2013.01); *H01F 17/045* (2013.01); *H01F 27/24* (2013.01); *H01F 27/29* (2013.01); *H01F 27/292* (2013.01)

(58) Field of Classification Search
CPC .... H01F 27/2823; H01F 17/045; H01F 27/24; H01F 27/292
See application file for complete search history.

(56) References Cited

U.S. PATENT DOCUMENTS 4,704,592 A * 11/1987 Marth ..... H01F 17/045 336/83
6,348,850 B1 * 2/2002 Kimura ..... H01F 17/045 336/200
(Continued)

FOREIGN PATENT DOCUMENTS

JP 2001-015354 A 1/2001
JP 2001015354 A * 1/2001 ..... H01F 17/062
(Continued)

OTHER PUBLICATIONS

An Office Action; "Notice of Reasons for Refusal," mailed by the Japanese Patent Office dated Feb. 8, 2022, which corresponds to Japanese Patent Application No. 2019-115388 and is related to U.S. Appl. No. 16/891,777 with English language translation.

*Primary Examiner* — Marlon T Fletcher
*Assistant Examiner* — Malcolm Barnes
(74) *Attorney, Agent, or Firm* — Studebaker & Brackett PC

(57) ABSTRACT

A wire-wound inductor component includes a core having a columnar shaft portion, first and second support portions provided on first and second end portions of the shaft portion, first and second terminal electrodes provided on the respective support portions, a wire wound around the shaft portion, and a cover member covering an upper surface of the shaft portion. In a height direction of the core, a distance between an upper surface and a top surface of the support portions is a top surface step, and a distance between a lower surface of the shaft portion and a bottom surface of the support portions is a bottom surface step. The top surface step is smaller than the bottom surface step and larger than a wire diameter, and a distance between the upper surface and an uppermost surface of the wire is larger than half of the top surface step.

22 Claims, 9 Drawing Sheets

(51) Int. Cl.
*H01F 27/24* (2006.01)
*H01F 17/04* (2006.01)

(56) References Cited

U.S. PATENT DOCUMENTS 6,472,969 B1 * 10/2002 Hanato ..... H01F 17/045 336/200
2003/0071704 A1 * 4/2003 Toi ..... H01F 27/36 336/83
2005/0145408 A1 * 7/2005 Hess ..... H05K 3/3442 174/541
2010/0090790 A1 * 4/2010 Azuma ..... H01F 17/045 336/221
2010/0214050 A1 * 8/2010 Opina, Jr. ..... H01F 27/292 29/606
2013/0154784 A1 * 6/2013 Hachiya ..... H01F 5/003 336/200
2016/0240306 A1 * 8/2016 Kanbe ..... H01F 17/045
2017/0125157 A1 * 5/2017 Hess ..... H01F 27/24
2017/0263373 A1 * 9/2017 Ashizawa ..... H01F 27/29
2017/0330672 A1 * 11/2017 Uchida ..... H01F 27/292
2018/0114628 A1 * 4/2018 Miyamoto ..... H01F 17/045
2018/0130597 A1 * 5/2018 Komaya ..... H01F 17/045

FOREIGN PATENT DOCUMENTS

JP 2002-110428 A 4/2002
JP 2002110428 A * 4/2002
JP 2003-243226 A 8/2003
JP 2003243226 A * 8/2003
JP 2005-322820 A 11/2005
JP 2008-060593 A 3/2008
JP 2008060593 A * 3/2008
JP 2014-199904 A 10/2014
JP 2016-152273 A 8/2016
JP 2017163099 A 9/2017

* cited by examiner

WIRE-WOUND INDUCTOR COMPONENT

CROSS-REFERENCE TO RELATED APPLICATION

This application claims benefit of priority to Japanese Patent Application No. 2019-115388, filed Jun. 21, 2019, the entire content of which is incorporated herein by reference.

BACKGROUND

Technical Field

The present disclosure relates to a wire-wound inductor component.

Background Art

Existing various types of inductor components are mounted on an electronic apparatus. A wire-wound inductor component includes a core and a wire wound around the core. The core includes a shaft portion around which a wire is wound, and a first support portion and a second support portion that are respectively provided at both ends of the shaft portion and that protrude in a direction intersecting with an axial direction of the shaft portion. A terminal electrode is formed on each bottom surface of the first support portion and the second support portion, as described, for example, in Japanese Unexamined Patent Application Publication No. 2017-163099).

In the existing wire-wound inductor component as described above, a terminal electrode is generally formed by a dip method from the viewpoint of productivity. Specifically, bottom surfaces of the first support portion and the second support portion are immersed in a tank filled with an electrode material, and the electrode material is applied from the bottom surfaces over to surrounding surfaces, and the electrode material is baked by baking or the like to form the terminal electrode. In addition, in view of a fixing force on a circuit board after mounting of the wire-wound inductor component and visibility of solder bonding, a height of the terminal electrode formed on a peripheral surface of the bottom surface of the support portion needs to be secured to a certain level or more. Further, when the terminal electrode is brought into contact with a wire wound around the shaft portion, there is a possibility that a short circuit or the like may occur, and therefore, it is necessary to secure a certain distance or more between the terminal electrode and the shaft portion.

From the above, it is necessary to set a distance (bottom surface step) between a lower surface of the shaft portion and the bottom surface of the support portion in a height direction of the core to be a certain level (the sum of a required height of the terminal electrode and a required distance between the terminal electrode and the shaft portion) due to an application accuracy of the dip method. Since this value of a certain level or more is determined irrespective of a dimension of the core, for example, it may be a major obstacle for achieving a reduction in height of the core, such as a height dimension of equal to or less than about 0.5 mm.

Further, in general, the core alone is formed in a substantially line symmetric shape without distinction between a top surface and the bottom surface, thereby generating a manufacturing advantage in that a uniform pressure is applied to the shaft portion during press molding of the core in which the formation direction of the terminal electrode with respect to the core is not limited. On the other hand, in this case, it is necessary to set a distance (top surface step) between an upper surface of the shaft portion and a top surface of the support portion in the height direction of the core to the same value as that of the bottom surface step, thereby making it more noticeable a trouble in achieving the reduction in the height.

Additionally, since the above-described existing wire-wound inductor component is mounted on a circuit board or the like generally using an automatic surface mount machine or the like, an upper portion of the core is covered by a cover member in a manner such that the top surface side becomes a suction surface of the automatic surface mount machine and the upper surface is made to be flat. However, in a case where miniaturization of the core has progressed, when the top surface step is set to the same value as the bottom surface step, that is, the top surface step is secured at a certain level or more regardless of the size of the dimension of the core as described above, a length dimension of the core becomes small, so that a space in the upper portion of the shaft portion covered by the cover member becomes narrower and deeper. Although the cover member is generally formed by applying a resin, in a case where the coating space is narrow and deep, the molding difficulty of the cover member becomes high.

As described above, the existing wire-wound inductor component is not suitable for realizing reduction in height and size.

SUMMARY

Accordingly, the present disclosure provide a wire-wound inductor component suitable for reduction in height and size.

A wire-wound inductor component according to an aspect of the present disclosure includes a core having a pair of support portions provided on both ends of columnar shaft portion; terminal electrodes respectively provided at the pair of support portions; a wire wound around the shaft portion and both end portions are connected respectively to the terminal electrodes of the pair of support portions; and a cover member disposed between at least the pair of support portions and covering an upper surface of the shaft portion. A distance between the upper surface of the shaft portion and a top surface of the pair of support portions in a height direction of the core is defined as a top surface step, and a distance between a lower surface of the shaft portion and a bottom surface of the pair of the support portions in a height direction of the core is defined as a bottom surface step. The top surface step is smaller than the bottom surface step, the top surface step is larger than a wire diameter of the wire, and a distance between an upper surface of the shaft portion and an uppermost surface of the wire is larger than half of the top surface step.

Other features, elements, characteristics and advantages of the present disclosure will become more apparent from the following detailed description of preferred embodiments of the present disclosure with reference to the attached drawings.

DETAILED DESCRIPTION

Hereinafter, an embodiment will be described.

It should be noted that the accompanying drawings may illustrate by enlarging constituent elements in order to facilitate understanding. The dimensional ratio of the constituent elements may be different from actual one or may differ from that in other figures. Although hatching is used in the cross-sectional view, hatching of some constituent elements may be omitted for ease of understanding.

A wire-wound inductor component 10 illustrated in FIG. 1, FIG. 2, FIG. 3, and FIG. 4 is a surface-mounted component mounted on, for example, a circuit board or the like. The wire-wound inductor component 10 may be used in a variety of devices including, for example, portable electronic devices (mobile electronic devices) such as smart phones or mobile electronic devices (e.g., smart watches) for wrist donning.

Figure 1:
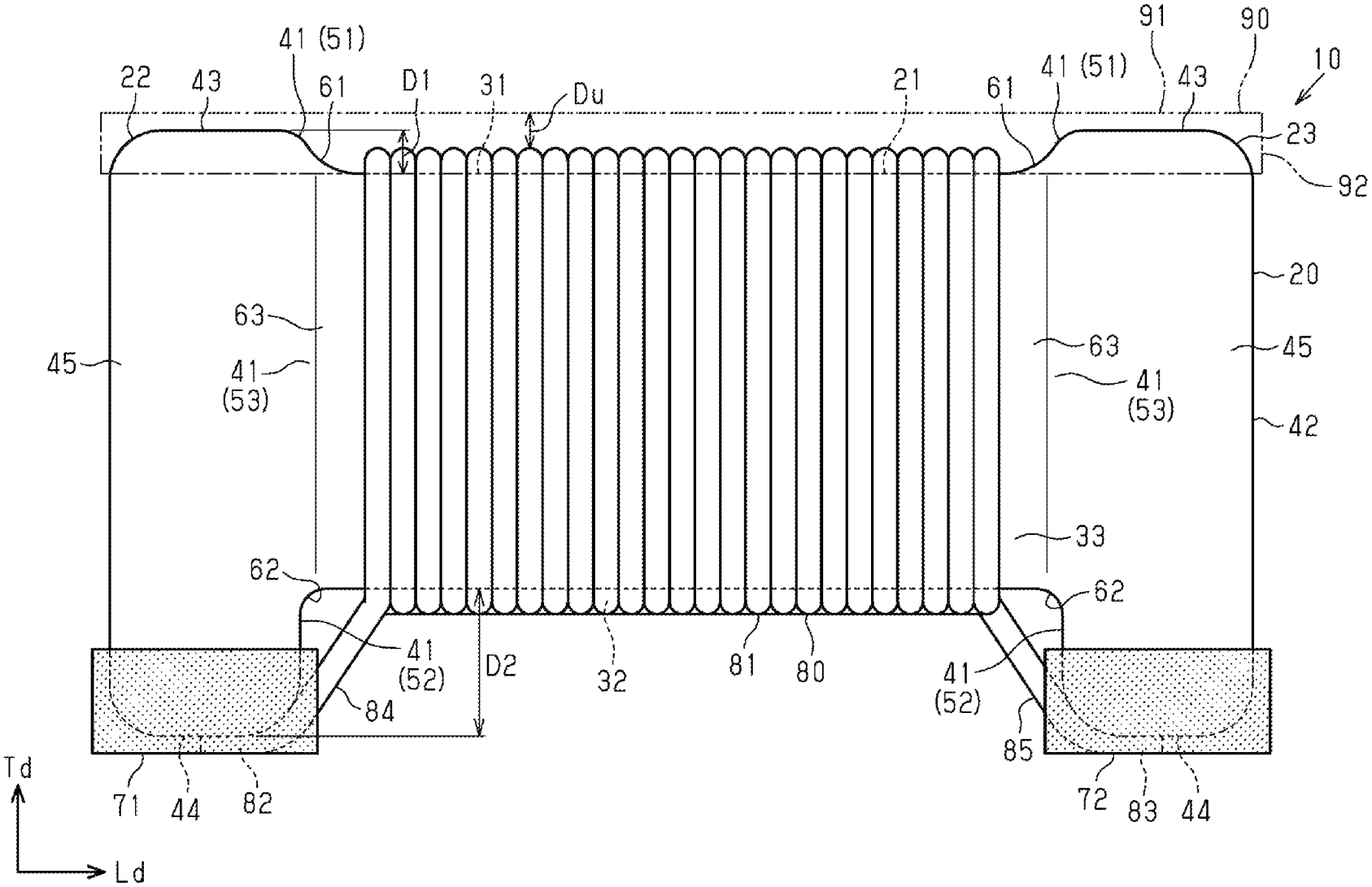
FIG. 1 is a front view of a wire-wound inductor component according to an embodiment.
Figure 2:
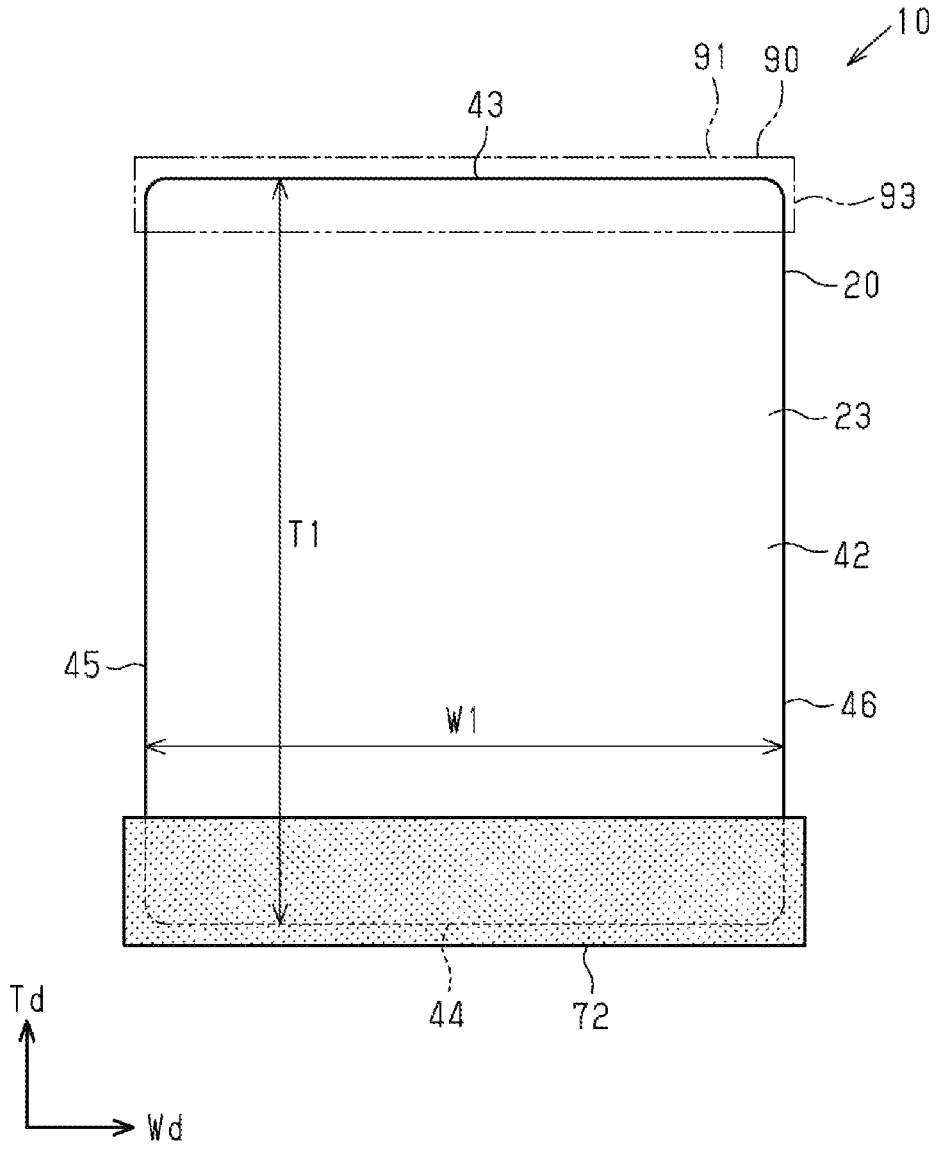
FIG. 2 is an end view of the wire-wound inductor component according to the embodiment.

The wire-wound inductor component 10 includes a core 20, a first terminal electrode 71, a second terminal electrode 72, a wire 80, and a cover member 90. In FIG. 1 and FIG. 2, the cover member 90 is illustrated by a long dashed double-dotted line, and in FIG. 3, the cover member 90 is omitted.

The core 20 includes a substantially columnar shaft portion 21 extending in a longitudinal direction Ld, a first support portion 22 and a second support portion 23 respectively provided in a first end portion and a second end portion of the shaft portion 21 in the longitudinal direction Ld.

The shaft portion 21 has, for example, a substantially quadrangular prism shape. The shaft portion 21 includes an upper surface 31 and a lower surface 32 on both sides in a height direction Td, and a pair of side surfaces 33 and 34 on both sides in a width direction Wd.

The first support portion 22 and the second support portion 23 are formed in a substantially flange-like shape having a main surface formed in a substantially rectangular shape extending orthogonal to the longitudinal direction Ld from both ends of the shaft portion 21. The first support portion 22 and the second support portion 23 support the shaft portion 21 in a manner such that the longitudinal direction Ld in which the shaft portion 21 extends is parallel to the circuit board that is a target for mounting. The first support portion 22 and the second support portion 23 are formed integrally with the shaft portion 21. It is preferable that a corner portion and a ridge line portion of the shaft portion 21, the first support portion 22, and the second support portion 23 are curved or flat by barrel finishing, chamfering, or the like.

As illustrated in FIG. 1 and FIG. 2, the first support portion 22 and the second support portion 23 include inner surfaces 41 facing the shaft portion 21 side in the longitudinal direction Ld, end surfaces 42 facing toward an outer side portion opposite to the inner surfaces 41, a top surface 43 and a bottom surface 44 on both sides in the height direction Td, and a pair of side surfaces 45 and 46 on both sides in the width direction Wd. The inner surface 41 of the first support portion 22 is opposed to the inner surface 41 of the second support portion 23. Note that the bottom surface 44 is a surface opposed to the circuit board when the wire-wound inductor component 10 is mounted on the circuit board. The side surfaces 45 and 46 are a surface that is not the inner surface 41, the end surface 42, the top surface 43, and the bottom surface 44.

The side surfaces 45 of the first support portion 22 and the second support portion 23 face in substantially the same direction as the side surface 33 of the shaft portion 21, and the side surfaces 46 of the first support portion 22 and the second support portion 23 face in substantially the same direction as the side surface 34 of the shaft portion 21. The top surfaces 43 of the first support portion 22 and the second support portion 23 face in substantially the same direction as the upper surface 31 of the shaft portion 21, and the bottom surfaces 44 of the first support portion 22 and the second support portion 23 face in substantially the same direction as the lower surface 32 of the shaft portion 21.

As a material of the core 20, a magnetic material (for example, nickel (Ni)-zinc (Zn) based ferrite, manganese (Mn)—Zn based ferrite), alumina, a metal magnetic material, or the like can be used. The powder of these materials is compacted and sintered to obtain the core 20. Further, the core 20 may be a molded product made of a resin containing magnetic powder.

The first terminal electrode 71 and the second terminal electrode 72 are provided on the first support portion 22 and the second support portion 23. The first terminal electrode 71 and the second terminal electrode 72 cover the entire surface of the bottom surface 44 and end portions on the bottom surface 44 side of the inner surface 41, the end surface 42, and the bottom surface 44 in the first support portion 22 and the second support portion 23. The first terminal electrode 71 and the second terminal electrode 72 are formed by baking a conductive paste containing silver (Ag) as a conductive component, for example, by a dip method or the like, and on the surface thereof, plating such as Ni, copper (Cu), tin (Sn), or the like may be applied, when necessary.

Figure 6A:
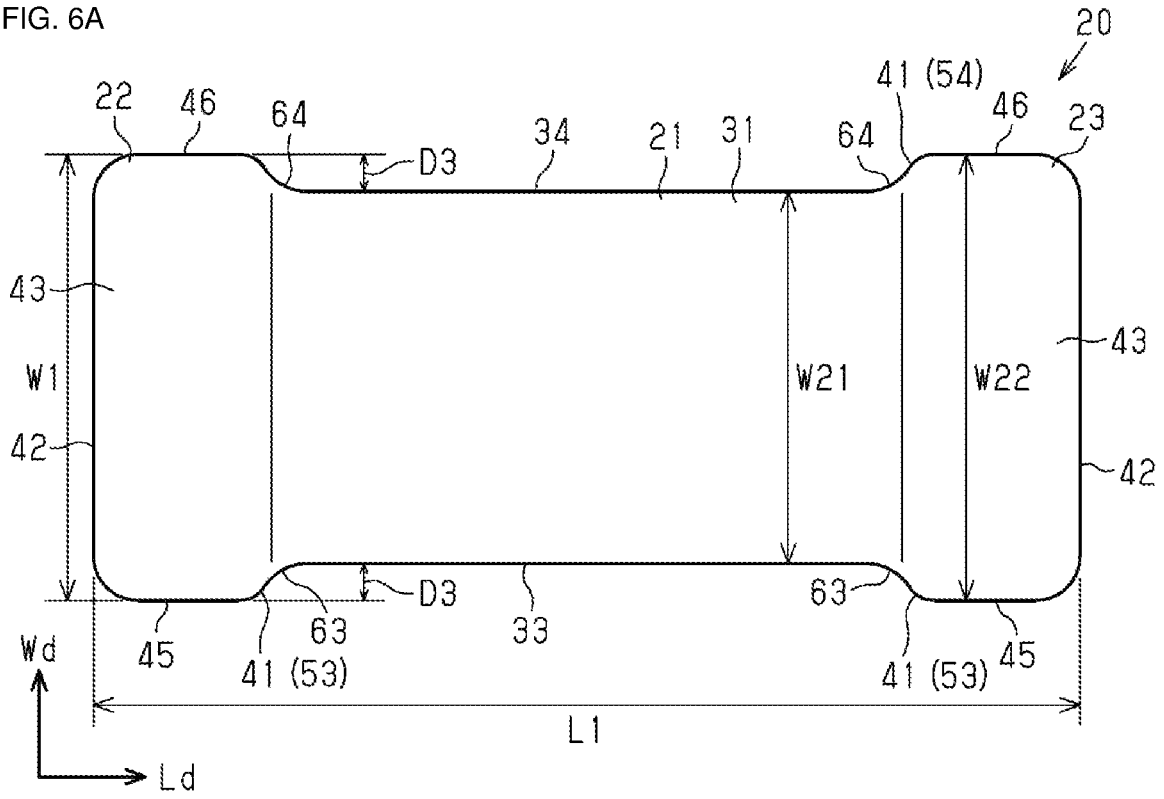
FIG. 6A is a plan view of a core.

Note that as described above, in this specification, a direction in which the shaft portion 21 extends is referred to as the "longitudinal direction Ld". In addition, the "height direction Td" is a direction orthogonal to the bottom surfaces 44 of the first support portion 22 and the second support portion 23 which are covered by the first terminal electrode 71 and the second terminal electrode 72. Further, the "width direction Wd" is a direction orthogonal to the "longitudinal direction Ld" and the "height direction Td". Note that a "height dimension T1 of the core" is a height along the height direction Td of the core 20, and specifically, is a dimension between the top surface 43 and the bottom surface 44 as illustrated in FIG. 2. A "width dimension W1" is a width along the width direction Wd of the core 20, and specifically, is a dimension between the pair of side surfaces 45 and 46 as illustrated in FIG. 2. A "length dimension L1"

is a length along the longitudinal direction Ld of the core 20, and specifically, is a dimension between the end surface 42 of the first support portion 22 and the end surface 42 of the second support portion 23 as illustrated in FIG. 6A. Note that in the following description, the first support portion 22 and the second support portion 23 are substantially symmetrical to each other, and the height dimension T1 and the width dimension W1 of the core 20 may be described as the height dimension T1 and the width dimension W1 of the first support portion 22, respectively.

The wire 80 has a winding portion 81 wound around the shaft portion 21, a first end 82 and a second end 83 respectively connected to the first terminal electrode 71 and the second terminal electrode 72, and crossover portions 84 and 85 hung between the respective first end 82 and the second end 83 and the winding portion 81. The winding portion 81 is wound around the shaft portion 21 so as to form, for example, a single layer with respect to the shaft portion 21. Note that the winding portion 81 is not limited to a single layer and may be wound around the shaft portion 21 so as to form a plurality of layers. Further, a plurality of the wires 80 may be wound around the shaft portion 21.

The wire 80 includes, for example, a core wire having a substantially circular cross section and a coating material coating a surface of the core wire. As the material of the core wire, for example, a conductive material such as Cu or Ag may be used as a main component. As the material of the coating material, for example, an insulating material such as polyurethane, polyester, polyamide imide, or the like can be used.

The first end 82 and the second end 83 of the wire 80 are electrically connected to the first terminal electrode 71 and the second terminal electrode 72, respectively. For example, solder may be used to connect the first end 82 and the second end 83 to the first terminal electrode 71 and the second terminal electrode 72, respectively. For example, an Sn plating layer is formed on surfaces of the first terminal electrode 71 and the second terminal electrode 72, and the first end 82 and the second end 83 are thermally pressure-bonded, whereby the coating material is dissolved and volatilized by heat and the core wire is embedded in the Sn plating layer, so that the first end 82 and the second end 83 may be electrically connected to the first terminal electrode 71 and the second terminal electrode 72. Note that the method for connecting the first end 82 and the second end 83 to the first terminal electrode 71 and the second terminal electrode 72 is not limited thereto, and various known methods may be used, for example, a method in which the first end 82 and the second end 83 from which the coating material have been previously peeled are welded to the first terminal electrode 71 and the second terminal electrode 72.

When the cross section of the wire 80 is substantially circular, a diameter of the cross section, which is a wire diameter, is preferably in the range of from about 14 μm to about 20 μm, and more preferably in the range of from about 15 μm to about 17 μm. In this embodiment, a wire diameter of the wire 80 is about 16 μm. Since the wire diameter of the wire 80 is large, it is possible to suppress an increase in a resistance component, and it is possible to suppress a protrusion from an outer form of the core 20 due to the small wire diameter.

Figure 3:
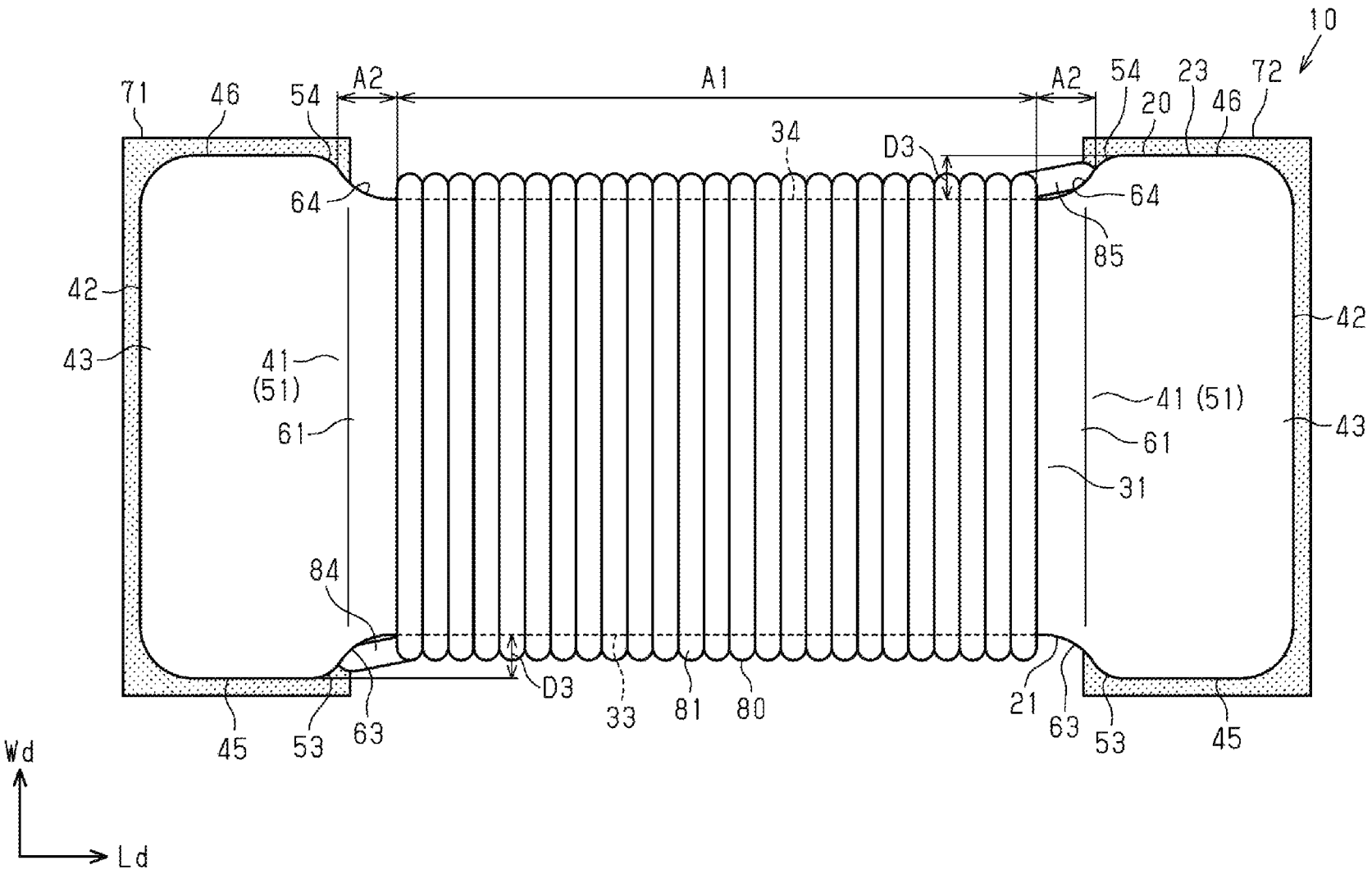
FIG. 3 is a plan view of the wire-wound inductor component according to the embodiment.
Figure 4:
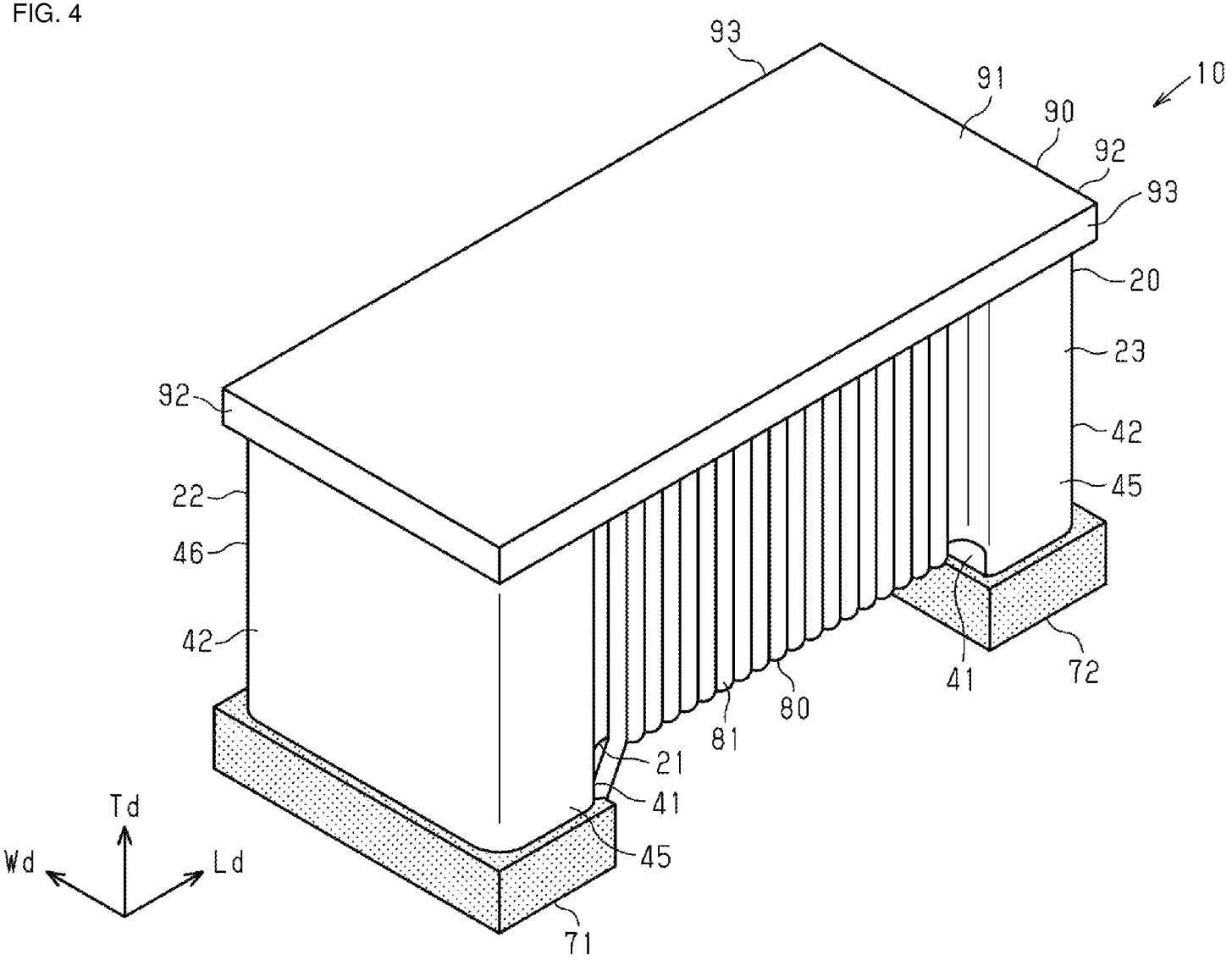
FIG. 4 is a perspective view of the wire-wound inductor component according to the embodiment.

As illustrated in FIG. 3, in the wire-wound inductor component 10, it is preferable that the upper surface 31 of the shaft portion 21 have a covered region A1 covered by the wire 80 and an exposed region A2 not covered by the wire 80, and that an area of the covered region A1 be larger than an area of the exposed region A2. Since the wire 80 have the winding portion 81 wound around the shaft portion 21, the covered region A1 is a region covered by the winding portion 81, and the exposed region A2 is a region not covered by the winding portion 81.

When the area of the covered region A1 is larger than the area of the exposed region A2, a portion on the covered region A1 where the cover member 90 is relatively thin has a range wider than a portion on the exposed region A2 where the cover member 90 is relatively thick, so that the cover member 90 can be made thinner. Accordingly, since less application amount of a resin to be the cover member 90 with respect to the core 20 is required, it is possible to further suppress a protrusion amount of the cover member 90 from the core 20 due to the resin protruding in the longitudinal direction Ld and the width direction Wd before the resin is solidified, and therefore an outer dimension of the wire-wound inductor component 10 can be reduced. In addition, it is possible to further reduce the difficulty in the flat surface of a top surface 91 of the cover member 90, and for example, it is possible to further reduce the possibility that the winding portion 81 of the wire 80 is exposed due to being cut off of the cover member 90.

The cover member 90 is formed so as to cover the winding portion 81 of the wire 80 wound around the shaft portion 21. In this embodiment, the cover member 90 is formed so as to cover the upper surface 31 of the shaft portion 21 and the top surfaces 43 of the first support portion 22 and the second support portion 23. The cover member 90 has the top surface 91 oriented in the same direction as the top surfaces 43 of the first support portion 22 and the second support portion 23 in the height direction Td, a pair of end surfaces 92 on both sides in the longitudinal direction Ld, and a pair of side surfaces 93 on both sides in the width direction Wd. The top surface 91 of the cover member 90 is a flat surface. For example, when the wire-wound inductor component 10 is mounted on the circuit board, the cover member 90 forms the top surface 91 that is a flat suction surface in a manner such that suction by a suction nozzle of an automatic mounting machine can be reliably performed.

Figure 5:
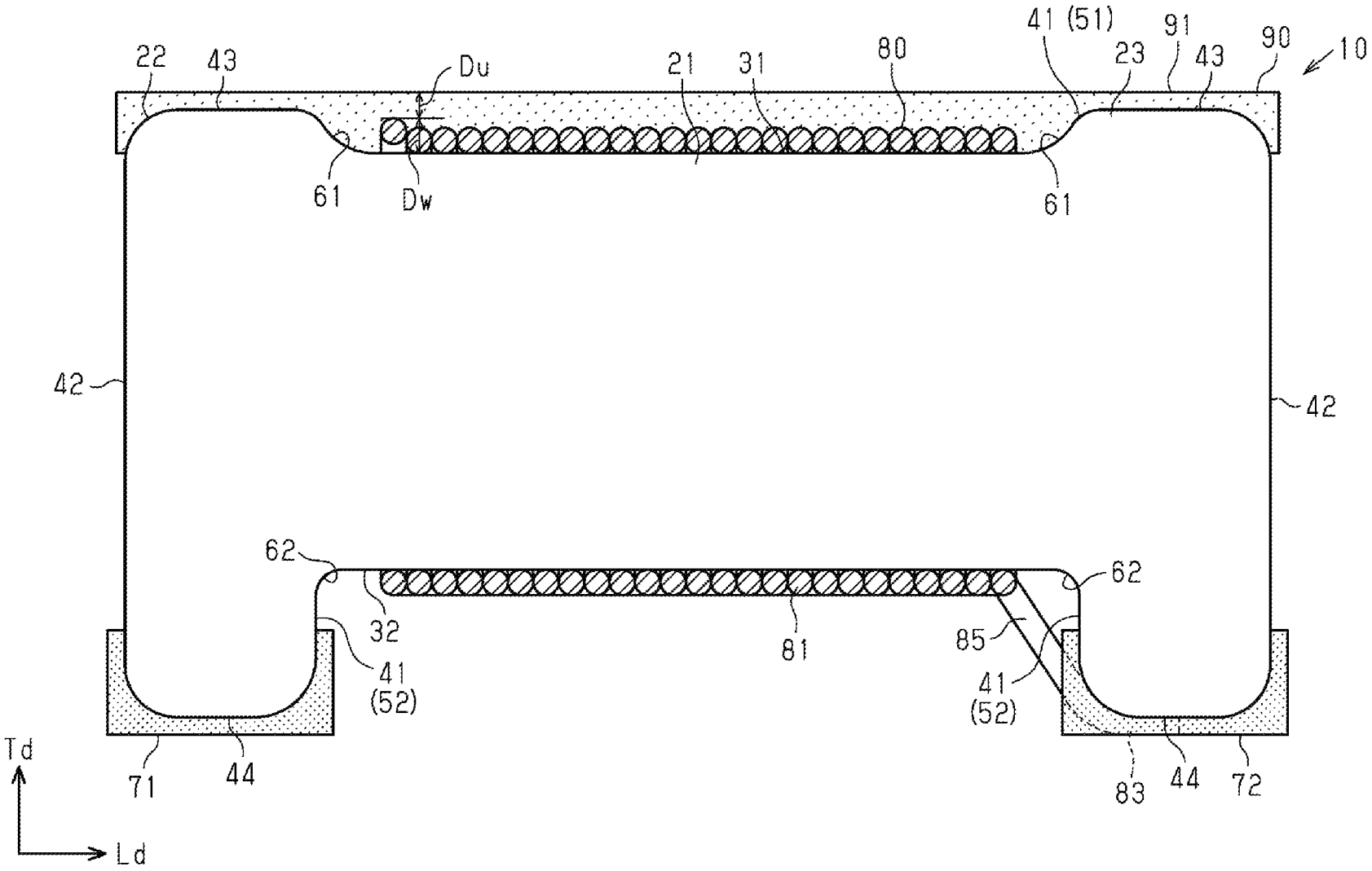
FIG. 5 is a schematic cross-sectional view of the wire-wound inductor component according to the embodiment.

As illustrated in FIG. 1 and FIG. 5, since the wire 80 includes the winding portion 81 wound around the shaft portion 21, an uppermost surface of the winding portion 81 wound around the shaft portion 21, that is, a surface farthest from the upper surface 31 of the winding portion 81 on the upper surface 31 of the shaft portion 21, becomes an uppermost surface of the wire 80. As illustrated in FIG. 5, a thickness Du of the cover member 90 on the winding portion 81 of the wire 80 is defined as a distance between the uppermost surface of the winding portion 81 on the upper surface 31 of the shaft portion 21 along the height direction Td and the top surface 91 of the cover member 90. Note that when the winding portion 81 is wound about the shaft portion 21 so as to form a plurality of layers, the uppermost surface of the winding portion 81 is an upper surface of an uppermost layer of the wound winding portion 81. It is preferable that the thickness Du of the cover member 90 be smaller than the wire diameter of the wire 80. Thus, the cover member 90 becomes thinner, and the effect obtained by making the above-described cover member 90 be thinner is further emphasized.

Figure 6B:
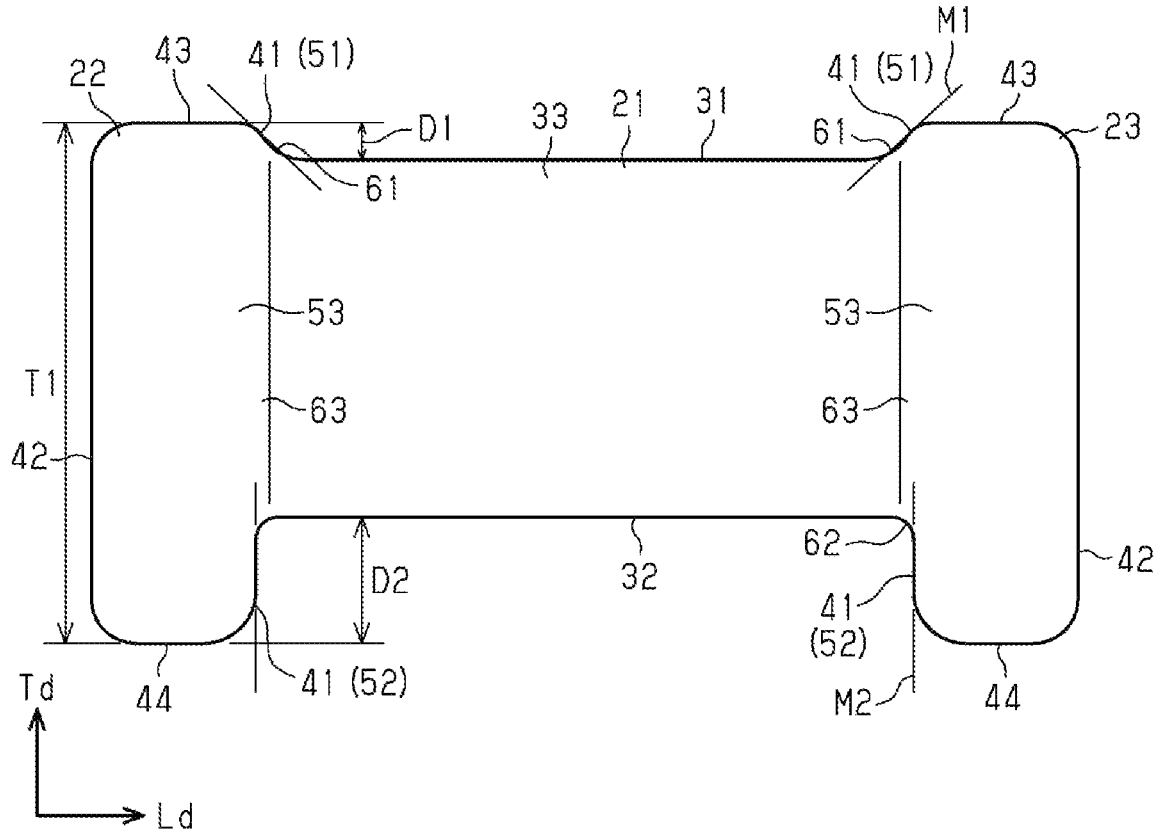
FIG. 6B is a front view of the core.

As illustrated in FIGS. 6A and 6B, the core 20 of this embodiment has the length dimension L1 of about 1.0 mm, the height dimension T1 of about 0.35 mm, and the width dimension W1 of about 0.3 mm, for example. Note that the length dimension L1, the height dimension T1, and the width dimension W1 of the core 20 are not limited to this. For example, in the core 20, the length dimension L1 may be equal to or more than about 0.6 mm and equal to or less than about 1.6 mm (i.e., from about 0.6 mm to about 1.6 mm), the height dimension T1 may be equal to or more than about 250 μm and equal to or less than about 400 μm (i.e., from about 250 μm to about 400 μm), and the width dimension W1 may be equal to or more than about 200 μm and equal to or less than about 350 μm (i.e., from about 200 μm to about 350 μm). Thus, it is possible to reduce the possibility of contact with other components or other members adjacent to each other in the longitudinal direction Ld, the height direction Td, and the width direction Wd.

It is preferable that the height dimension T1 of the core 20 is larger than the width dimension W1 of the core 20, and the difference between the height dimension T1 and the width dimension W1 is in the range of equal to or larger than about 30 μm and equal to or less than about 70 μm (i.e., from about 30 μm to about 70 μm). Thus, the core 20 can be miniaturized without sacrificing its characteristics while maintaining workability.

Note that in this embodiment, since the first support portion 22 and the second support portion 23 are substantially symmetrical to each other and have a similar configuration, a common portion will be described by using the first support portion 22, and a case where the first support portion 22 and the second support portion 23 are required will be described with reference to the first support portion 22 and the second support portion 23. As described above, the first support portion 22 is a substantially flanged member having a substantially rectangular main surface extending perpendicularly to the longitudinal direction Ld from both ends of the shaft portion 21. Accordingly, the top surface 43, the bottom surface 44, and the side surfaces 45 and 46 of the first support portion 22 are located at an outside portion of the upper surface 31, the lower surface 32, and the side surfaces 33 and 34 of the shaft portion 21, centering on the shaft portion 21. Therefore, the core 20 has a step between each surface of the shaft portion 21 and each surface of the first support portion 22.

Specifically, as illustrated in FIG. 6B, the core 20 has a top surface step D1 which is a distance between the upper surface 31 of the shaft portion 21 in the height direction Td and the top surface 43 of the first support portion 22. The top surface step D1 is a difference between a height of the top surface 43 of the first support portion 22 and a height of the upper surface 31 of the shaft portion 21. Further, the core 20 has a bottom surface step D2 which is a distance between the lower surface 32 of the shaft portion 21 in the height direction Td and the bottom surface 44 of the first support portion 22. The bottom surface step D2 is a difference between a height of the lower surface 32 of the shaft portion and a height of the bottom surface 44 of the first support portion 22. Note that although the top surface step D1 and the bottom surface step D2 are indicated by an average of the steps in the first support portion 22 and the second support portion 23, when the first support portion 22 and the second support portion 23 are substantially symmetrical to each other, the step in any one of the first support portion 22 and the second support portion 23 may be defined as the top surface step D1 and the bottom surface step D2.

As illustrated in FIG. 6A, the core 20 has a side surface step D3 which is a distance between the side surfaces 33 and 34 of the shaft portion 21 in the width direction Wd and the side surfaces 45 and 46 of the first support portion 22. In this embodiment, a distance between the side surface 33 and the side surface 45 in the width direction Wd and a distance between the side surface 34 and the side surface 46 are equal, and in this case, the side surface step D3 is ½ of the difference between the width dimension W21 of the shaft portion 21 and the width dimension W22 of the first support portion 22. Note that in the case where the first support portion 22 and the second support portion 23 are not substantially symmetrical to each other as described above, the side surface step D3 may be an average of the distance between the side surface 33 and the side surface 45 in the width direction Wd and the distance between the side surface 34 and the side surface 46.

In the core 20, the top surface step D1 is smaller than the bottom surface step D2. The top surface step D1 is preferably equal to or less than about 40% of the bottom surface step D2, and more preferably equal to or more than about 20% (i.e., from about 20% to about 40%). For example, when the bottom surface step D2 is set to about 85 μm, the top surface step D1 is preferably equal to or less than about 34 μm, and more preferably equal to or more than about 17 μm (i.e., from about 17 μm to about 34 μm). This makes it easier to lower the height of the core 20. Additionally, the cover member 90 can be made thinner.

Further, the top surface step D1 is preferably equal to or less than about 10% of the height dimension T1 of the first support portion 22, and more preferably equal to or more than about 5% (i.e., from about 5% to about 10%). For example, when the height dimension T1 of the first support portion 22 is set to about 350 μm, the top surface step D1 is preferably equal to or less than about 35 μm, and more preferably equal to or more than about 17.5 μm (i.e., from about 17.5 μm to about 35 μm). This makes it easier to lower the height of the core 20. Additionally, the cover member 90 can be made thinner.

Further, the top surface step D1 is preferably equal to or less than about 15% of the width dimension W1 of the first support portion 22, and more preferably equal to or more than about 5% (i.e., from about 5% to about 15%). For example, when the width dimension W1 of the first support portion 22 is set to about 300 μm, the top surface step D1 is preferably equal to or less than about 40 μm, and more preferably equal to or more than about 15 μm (i.e., from about 15 μm to about 40 μm). This makes it easier to lower the height of the core 20. Additionally, the cover member 90 can be made thinner.

In the core 20 of this embodiment, the bottom surface step D2 is about 85 μm, the height dimension T1 of the first support portion 22 is about 350 μm, the width dimension W1 of the first support portion 22 is about 300 μm, and the top surface step D1 is about 25 μm.

By lowering the top surface step D1, it is possible to thinly apply the resin to be used as the cover member 90. At this time, since less application amount of the resin to be the cover member 90 with respect to the core 20 is required, it is possible to suppress the protrusion amount of the cover member 90 due to the resin protruding in the longitudinal direction Ld and the width direction Wd before the resin is solidified, and therefore the outer dimension of the wire-wound inductor component 10 can be reduced.

Further, in the core 20, the top surface step D1 is smaller than the bottom surface step D2, and the top surface step D1 is larger than the wire diameter of the wire 80, and a distance Dw between the upper surface 31 of the shaft portion 21 and the uppermost surface of the winding portion 81 of the wire 80 is larger than half of the top surface step D1. That is, in the core 20, the top surface step D1 is equal to or more than the wire diameter and equal to or less than the bottom surface step D2, and the uppermost surface of the winding portion 81 is positioned at a position higher than a middle position of the top surface step D1.

With the configuration described above, the core 20 can set the top surface step D1 independently of a constraint on the bottom surface step D2 that the sum or more of a required height of the first terminal electrode 71 and the second terminal electrode 72 and a required space between the first terminal electrode 71 and the second terminal electrode 72 and the lower surface 32 of the shaft portion 21 are secured, thereby reducing a trouble in achieving a reduction in height.

Further, since the top surface step D1 is secured to the extent that the uppermost surface of the winding portion 81 does not protrude more than the top surface 43 of the first support portion 22 when the winding portion 81 of the wire 80 is wound around the shaft portion 21 by one layer, and since the cover member 90 does not extremely protrude beyond the top surface 43 when covering the winding portion 81 by the cover member 90, it is possible to reduce a trouble caused by the cover member 90 in order to achieve the reduction in height.

Further, since the top surface step D1 is set to such an extent that the space defined by the upper surface 31 of the shaft portion 21 on which the cover member 90 is arranged and the inner surface 41 of the first support portion 22 does not become too deep, the difficulty in forming the cover member 90 is reduced, thereby reducing a trouble in achieving miniaturization. In this case, since the uppermost surface of the winding portion 81 is close to the top surface 43 of the first support portion 22, less application amount of the resin to be the cover member 90 with respect to the core 20 is required, so that the outer dimension of the wire-wound inductor component 10 can be reduced.

Further, since the cover member 90 preferably covers the top surfaces 43 of the first support portion 22 and the second support portion 23 to thereby increase a contact area of the cover member 90 to the core 20, it is possible to improve an adhesion strength of the cover member 90 with respect to the core 20.

The inner surface 41 of the first support portion 22 includes the inner surface 41 on the top surface 43 side, i.e., a top inner surface 51 as the inner surface 41 located between the upper surface 31 of the shaft portion 21 and the top surface 43 of the first support portion 22, the inner surface 41 on the bottom surface 44 side, i.e., a bottom inner surface 52 as the inner surface 41 located between the lower surface 32 of the shaft portion 21 and the bottom surface 44 of the first support portion 22, the inner surface 41 on the side surface 45 side, i.e., a side inner surface 53 as the inner surface 41 located between the side surface 33 of the shaft portion 21 and the side surface 45 of the first support portion 22, and the inner surface 41 on the side surface 46 side, i.e., a side inner surface 54 as the inner surface 41 located between the side surface 34 of the shaft portion 21 and the side surface 46 of the first support portion 22.

In FIG. 6B, an inclination of the top inner surface 51 on the top surface 43 side of the first support portion 22 and the second support portion 23 is indicated by an auxiliary line M1, and an inclination of the bottom inner surface 52 on the bottom surface 44 side of the first support portion 22 and the second support portion 23 is indicated by an auxiliary line M2.

In the core 20, an angle formed by the bottom inner surface 52 and the bottom surface 44 of the first support portion 22 and the second support portion 23 is substantially a right angle. An angle formed by each of the side inner surfaces 53 and 54 and each of the side surfaces 45 and 46 of the first support portion 22 and the second support portion 23 is an obtuse angle larger than the right angle. An angle formed by the top inner surface 51 and the top surface 43 of the first support portion 22 and the second support portion 23 is an obtuse angle larger than the right angle. In this embodiment, as described above, it is preferable that the angle formed by the bottom inner surface 52 and the bottom surface 44 of the first support portion 22 and the second support portion 23 be smaller than any of the angle formed by each of the side surfaces 53 and 54 and each of the side surfaces 45 and 46 of the first support portion 22 and the second support portion 23, and the angle formed by the top inner surface 51 and the top surface 43 of the first support portion 22 and the second support portion 23. In the above description, the angle formed by two surfaces indicates an inner angle on an inner side of the core 20.

In the step of forming the first terminal electrode 71 and the second terminal electrode 72 in the core 20, an Ag paste which becomes the first terminal electrode 71 and the second terminal electrode 72 is applied to the bottom surfaces 44 of the first support portion 22 and the second support portion 23 by the above-described dip method. At this time, although the Ag paste is applied not only to the bottom surface 44 but also to the bottom inner surface 52, the Ag paste may wet up on the bottom inner surface 52 after application, and the first terminal electrode 71 and the second terminal electrode 72 may be brought close to or attached to the winding portion 81 of the shaft portion 21. In this case, the mounting solder adhering to the first terminal electrode 71 and the second terminal electrode 72 is liable to be caused to come into contact with the winding portion 81 of the wire 80 wound around the shaft portion 21, thereby causing a short circuit or damage to the coating material.

Here, as described above, when the bottom surfaces 44 on which the first terminal electrode 71 and the second terminal electrode 72 are formed are selected from surfaces of the first support portion 22 and the second support portion 23 which form a relatively small angle with the inner surface 41, since the bottom inner surface 52 extends from the bottom surface 44 in a direction not approaching the winding portion 81 wound around the shaft portion 21, it is possible to suppress the proximity or attachment of the first terminal electrode 71 and the second terminal 72 to the winding portion 81 wound around the shaft portion 21.

Note that it is most preferable that the angle formed by the bottom inner surface 52 and the bottom surface 44 of the first support portion 22 and the second support portion 23 be smaller than both of the angle formed by each of the side inner surfaces 53 and 54 and each of the side surfaces 45 and 46 of the first support portion 22 and the second support portion 23, and the angle formed by the top inner surface 51 and the top surface 43 of the first support portion 22 and the second support portion 23, but need only be smaller than any one of the angles. In particular, from the viewpoint of moldability of the core 20, it is preferable that the angle formed by the bottom inner surface 52 and the bottom surface 44, which is molded in the same direction, and the angle formed by the top inner surface 51 and the top surface 43 be different from each other.

Further, in the above description, the angle formed by the bottom inner surface 52 and the bottom surface 44 is a substantially right angle, the angle formed by each of the side inner surfaces 53 and 54 and each of the side surfaces 45 and 46, and the angle formed by the top inner surface 51 and the top surface 43 are obtuse angles, but not limited thereto, as long as the relative relationship is established. For example, the angle formed by the bottom inner surface 52 and the bottom surface 44 may be an acute angle or an obtuse angle close to a right angle.

As illustrated in FIGS. 6A and 6B, the core 20 of this embodiment has connection surfaces 61, 62, 63, and 64 between each surface of the shaft portion 21 and the inner surface 41 of the first support portion 22 and the second support portion 23. The inner surfaces 41 of the first support portion 22 and the second support portion 23 include the top inner surface 51, the bottom inner surface 52, and side inner surfaces 53 and 54. The connection surface 61 connects the top inner surface 51 of the first support portion 22 and the second support portion 23 to the upper surface 31 of the shaft portion 21. The connection surface 62 connects the bottom inner surface 52 of the first support portion 22 and the second support portion 23 to the lower surface 32 of the shaft portion 21. The connection surface 63 connects the side inner surfaces 53 of the first support portion 22 and the second support portion 23 to the side surface 33 of the shaft portion 21, and the connection surface 64 connects the side inner surfaces 54 of the first support portion 22 and the second support portion 23 to the side surface 34 of the shaft portion 21.

The connection surfaces 61, 62, 63, and 64 are a substantially concave cylindrical surface that is recessed toward the inside of the core 20. In this embodiment, it is preferable that a radius of curvature of the connection surface 62 be smaller than that of the connection surface 61. It is preferable that the radius of curvature of the connection surface 62 be smaller than both of the radius of curvature of the connection surfaces 63 and 64. Accordingly, since the bottom surfaces 44 on which the first terminal electrode 71 and the second terminal electrode 72 are formed are selected from the surfaces of the first support portion 22 and the second support portion 23 which have a relatively small radius of curvature of the connection surface with each surface of the shaft portion 21, the Ag paste applied to the bottom surface 44 is hardly spread to the shaft portion 21, and it is possible to suppress the proximity or attachment of the first terminal electrode 71 and the second terminal electrode 72 to the winding portion 81 wound around the shaft portion 21.

Note that the relative relationship of an angle formed by each surface of the first support portion 22 and the second support portion 23 and the inner surface 41 and the radius of curvature of the connection surface with each surface of the shaft portion 21 can also be used when determining the direction of the core 20, such as before forming the first terminal electrode 71 and the second terminal electrode 72 in the core 20, in the manufacturing process of the wire-wound inductor component 10. For example, a case will be considered in which the core 20 is irradiated with light from above, and the core 20 is photographed from above by an imaging apparatus such as a camera, and the direction of the core 20 is determined based on the obtained image data.

Figure 7A:
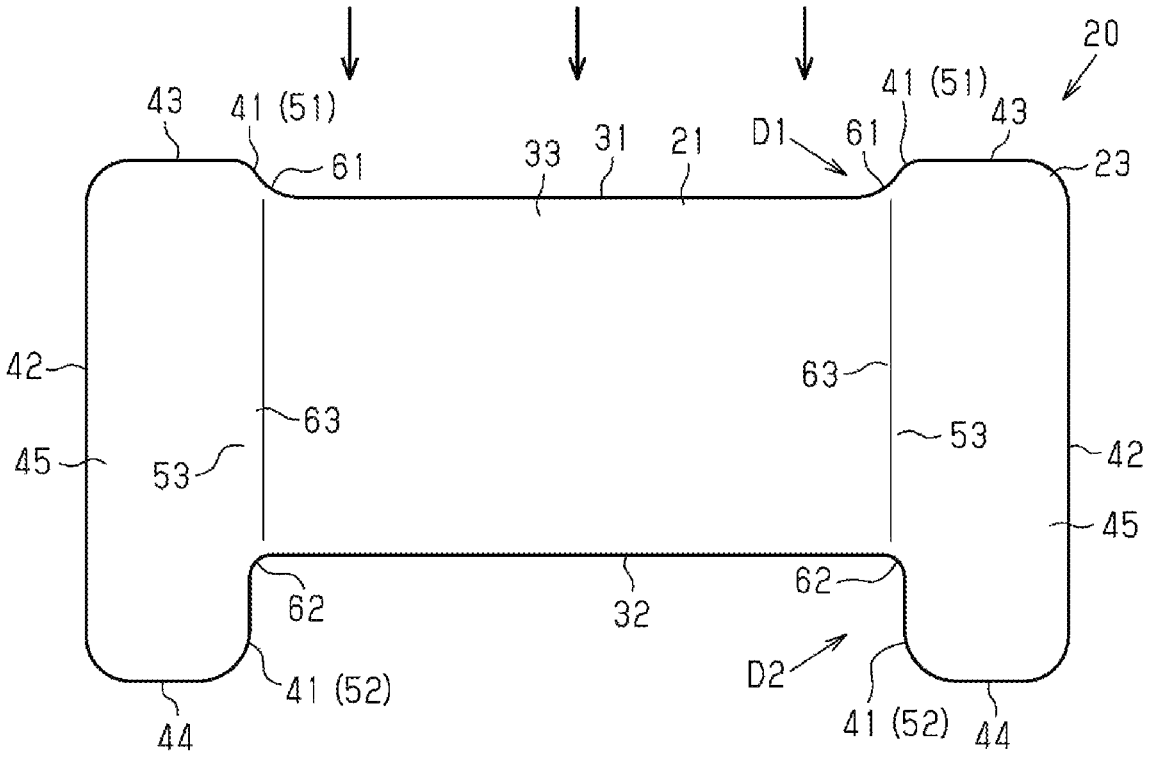
FIG. 7A is an explanatory view illustrating an example of irradiation of light to the core.
Figure 7B:
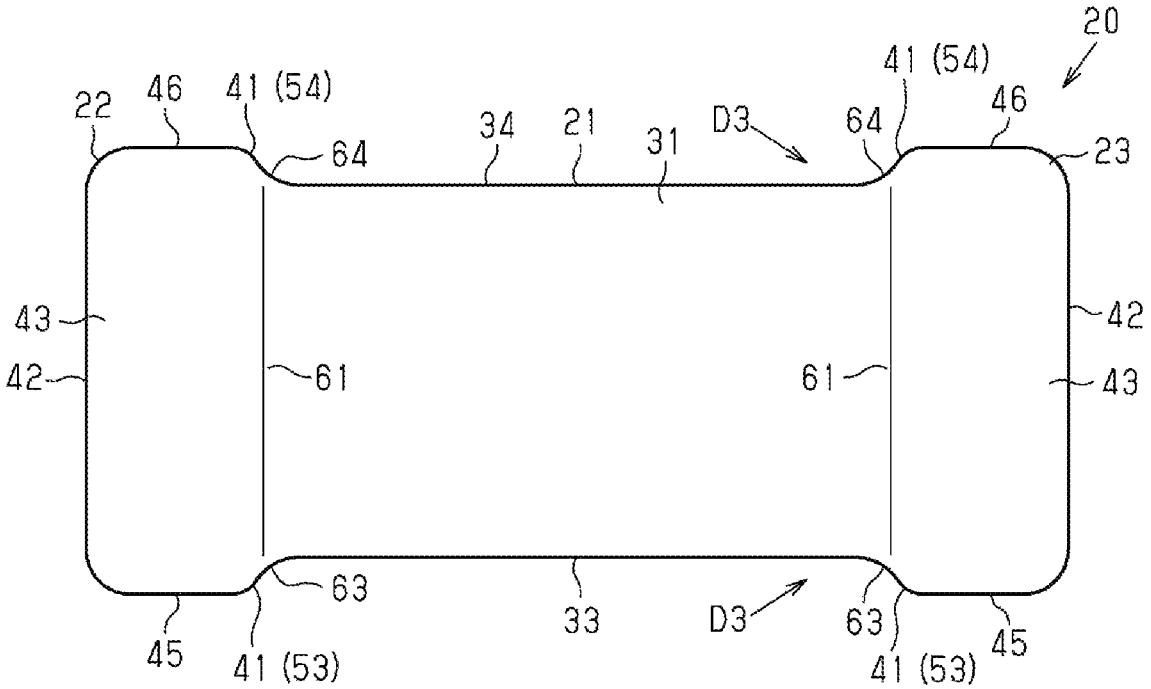
FIG. 7B is an explanatory diagram illustrating an example of image data of the core obtained by irradiation of FIG. 7A.
Figure 8A:
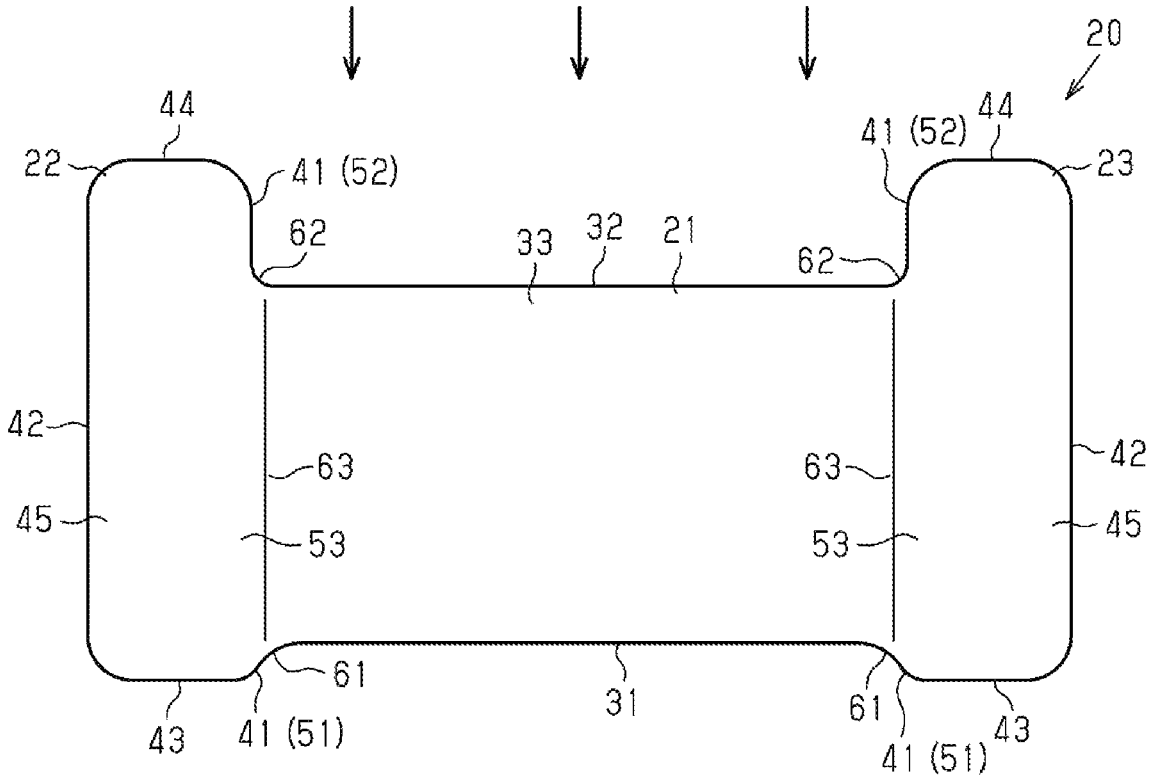
FIG. 8A is an explanatory view illustrating an example of irradiation of light to the core.
Figure 8B:
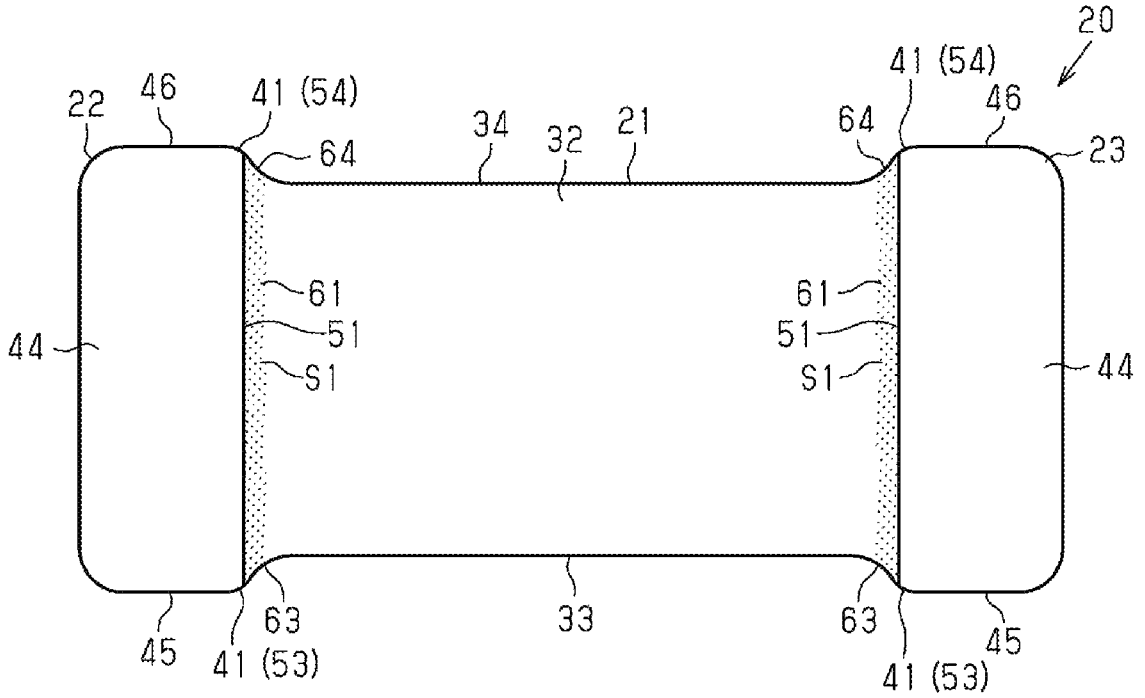
FIG. 8B is an explanatory diagram illustrating an example of image data of the core obtained by irradiation of FIG. 8A.

As illustrated in FIG. 7A and FIG. 8A, when light is irradiated to the core 20, the light is reflected in a direction other than an upper direction in the inner surface 41 and the connection surfaces 61, 62, 63, and 64 of the core 20, and the inner surface 41 and the connection surfaces 61, 62, 63, 64 are captured as a shadow in the image data obtained by the imaging device. FIG. 7A illustrates a case where light is irradiated from the side of the upper surface 31 of the shaft portion 21 in the core 20, and FIG. 7B illustrates an example of the image data obtained by the irradiation illustrated in FIG. 7A. FIG. 8B illustrates a case where light is irradiated from the side of the lower surface 32 of the shaft portion 21, and FIG. 8B illustrates an example of the image data obtained by the irradiation illustrated in FIG. 8A. Therefore, when the angles formed by the respective surfaces of the first support portion 22 and the second support portion 23 and the inner surfaces 41 or the radii of the curvature of the connection surfaces with the inner surfaces 41 are different from each other, the direction of the core 20 can be determined by a range or a density of the shadow located between the shaft portion 21 and the first support portion 22 and the second support portion 23 in the image data. As compared with the image data of the core 20 illustrated in FIG. 7B, in the image data of the core 20 illustrated in FIG. 8B, a shadow S1 is recognized. Accordingly, by determining the direction of the core 20 from the image data by an image recognition device or the visual observation, the core 20 can be aligned in a manner such that the bottom surfaces 44 of the first support portion 22 and the second support portion 23 are directed upward, and the application of the Ag paste to the first support portion 22 and the second support portion 23 can be made efficient.

It should be noted that it is preferable to satisfy the above relationship in both the first support portion 22 and the second support portion 23 with respect to the above angle and the radius of curvature, but not limited thereto, and it may be sufficient that the above angle and the radius of curvature are satisfied by only at least one of the first support portion 22 and the second support portion 23.

As described above, according to this embodiment, the following effects can be obtained.

(1) In the wire-wound inductor component 10, the top surface step D1 is smaller than the bottom surface step D2, the top surface step D1 is larger than the wire diameter of the wire 80, and the distance Dw between the upper surface 31 of the shaft portion 21 and the uppermost surface of the wire 80 is larger than half of the top surface step D1.

With the structure described above, the top surface step D1 can be set independently of the restriction on the bottom surface step D2, and a trouble in achieving a reduction in height can be reduced in the core 20. Further, the top surface step D1 is secured to a certain extent, and a trouble caused by the cover member 90 can also be reduced in order to realize a reduction in height. Moreover, the top surface step D1 is set to such an extent that the space in which the cover member 90 is arranged does not become too deep, thereby reducing the trouble in achieving miniaturization. Thus, the wire-wound inductor component 10 having the above-described structure is suitable for reduction in height and size.

In this case, since the uppermost surface of the winding portion 81 of the wire 80 is close to the top surface 43 of the first support portion 22 and the second support portion 23, less application amount of the resin to be the cover member 90 with respect to the core 20 is required, so that the outer dimension of the wire-wound inductor component 10 can be reduced.

(2) The area of the covered region A1 is larger than the area of the exposed region A2. Accordingly, the outer dimension of the wire-wound inductor component 10 can be further reduced. In addition, the difficulty of making a top surface 91 of the cover member 90 be a flat surface is further reduced, and for example, it is possible to further reduce the possibility that the winding portion 81 of the wire 80 is exposed due to being cut off of the cover member 90.

(3) The cover member 90 covers the first support portion 22 and the second support portion 23. Accordingly, the adhesion strength of the cover member 90 with respect to the core 20 can be improved.

(4) The angle formed by the bottom inner surface 52 and the bottom surface 44 of the first support portion 22 and the second support portion 23 is smaller than the angle formed by the top inner surface 51 and the top surface 43 of the first support portion 22 and the second support portion 23. Accordingly, it is possible to suppress the proximity or adhesion of the first terminal electrode 71 and the second terminal electrode 72 to the winding portion 81 of the wire 80 wound around the shaft portion 21. Further, in the manufacturing process of the wire-wound inductor component 10, it is possible to determine the direction of the core 20.

(5) The radius of curvature of the connection surface 62 is smaller than that of the connection surfaces 63 and 64. Accordingly, it is possible to suppress the proximity or adhesion of the first terminal electrode 71 and the second terminal electrode 72 to the winding portion 81 of the wire 80 wound around the shaft portion 21. In the manufacturing process of the wire-wound inductor component 10, it is possible to determine the direction of the core 20.

Modification

Additionally, the above embodiment may be modified as follows. Note that in a modification, the same reference numerals as those in the above-described embodiment are given to the configuration corresponding to the configuration in the above embodiment.

This embodiment and the following modification can be implemented in combination with each other within a technically compatible range.

Figure 9:
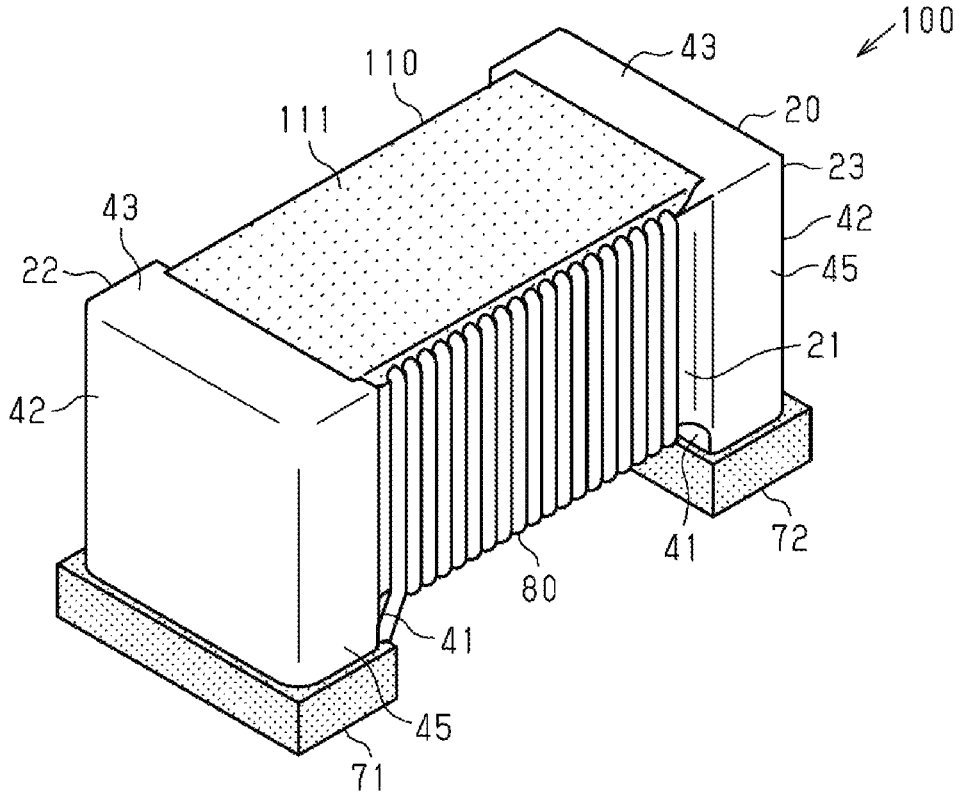
FIG. 9 is a perspective view of a wire-wound inductor component of a modification example.

As illustrated in FIG. 9, a cover member 110 of a wire-wound inductor component 100 may not cover the top surfaces 43 of the first support portion 22 and the second support portion 23, but may be disposed only between the first support portion 22 and the second support portion 23. The cover member 110 is formed so as to cover the winding portion 81 of the wire 80 wound around the shaft portion 21. The top surface 111 of the cover member 110 is flush with the top surfaces 43 of the first support portion 22 and the second support portion 23.

Figure 10:
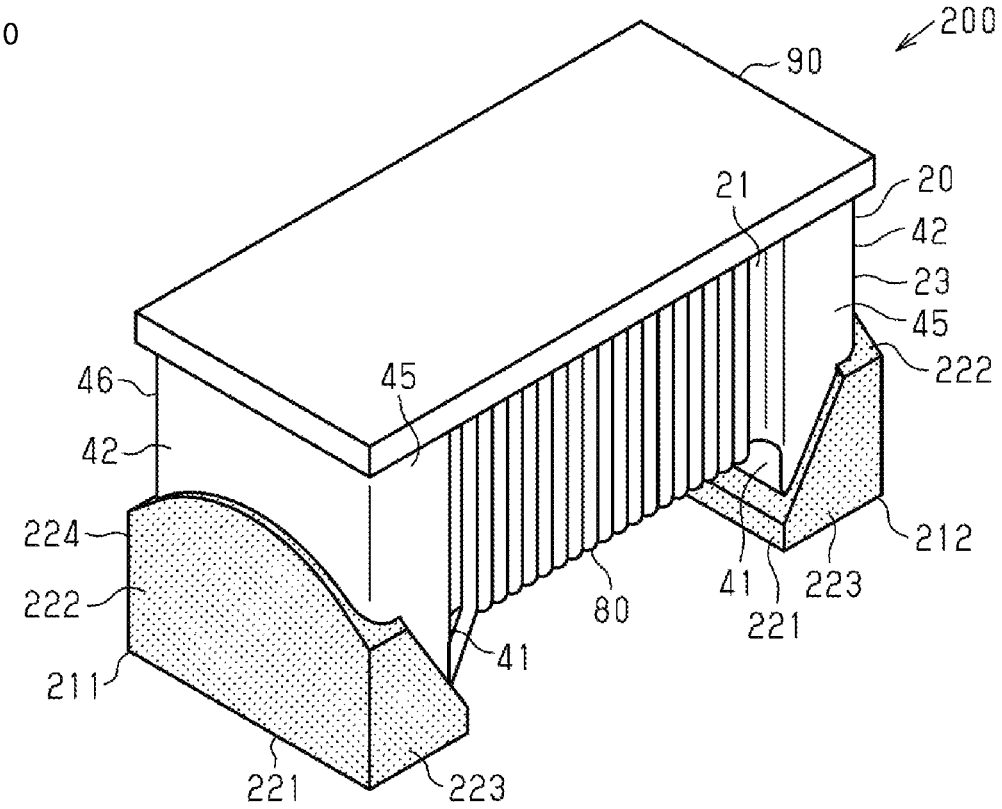
FIG. 10 is a perspective view of the wire-wound inductor component of the modification example.

As illustrated in FIG. 10, a wire-wound inductor component 200 may have a first terminal electrode 211 and a second terminal electrode 212 on the first support portion 22 and the second support portion 23. The first terminal electrode 211 and the second terminal electrode 212 are higher in height from end portions on the mutually opposite inner surfaces 41 side of the first support portion 22 and the second support portion 23 toward the end surfaces 42 side of the first support portion 22 and the second support portion 23.

The first terminal electrode 211 and the second terminal electrode 212 include bottom surface portion electrodes 221 at the bottom surfaces 44 of the first support portion 22 and the second support portion 23, end surface portion electrodes 222 at the end surfaces 42 of the first support portion 22 and the second support portion 23, side surface portion electrodes 223 and 224 at the side surfaces 45 and 46 of the first support portion 22 and the second support portion 23. The bottom surface portion electrodes 221 are formed over the entire bottom surfaces 44 of the first support portion 22 and the second support portion 23. The end surface portion electrodes 222 are formed so as to cover a lower portion which is a part of the end surfaces 42 of the first support portion 22 and the second support portion 23. The end surface portion electrode 222 is formed so as to continue from the bottom surface portion electrode 221 through a portion on the ridge line between the end surface 42 and the bottom surface 44.

The end surface portion electrode 222, in the end surface 42 of the first support portion 22 and the second support portion 23, has the center portion in the width direction Wd being higher than both end portions in the width direction Wd. Additionally, the upper end of the end surface portion electrode 222 has a substantially arc shape being convex to the upper side (the top surface 43 side). Further, the end portion of the end surface portion electrode 222 is higher than the side surface portion electrode 223 at the side surface 33.

The side surface portion electrodes 223 and 224 are formed so as to cover a lower portion as a part of the side surfaces 45 and 46 of the first support portion 22 and the second support portion 23. Further, the side surface portion electrodes 223 and 224 are formed so as to continue from the bottom surface portion electrode 221 and the end surface portion electrode 222 through a portion on each ridge line portion. In addition, as seen from the width direction Wd, the side surface portion electrodes 223 and 224 gradually increase in height from the inner surfaces 41 of the first support portion 22 and the second support portion 23 to the end surfaces 42, and have the highest height in the end surface portion electrodes 222.

The first terminal electrode 211 and the second terminal electrode 212 like this are increased in a surface area by increasing the height of portions that cover the end surfaces 42 of the first support portion 22 and the second support portion 23. This increase in the surface area allows a mounting solder to form a fillet highly along the end surface portion electrode 222 when mounting the wire-wound inductor component 200 on the circuit board, thereby further improving a fixing force of the wire-wound inductor component 200 with respect to the circuit board. In particular, even when the wire-wound inductor component 200 is miniaturized, it is easy to secure the fixing force. Additionally, the first terminal electrode 211 and the second terminal electrode 212 may partially have a portion lowered from the end portion on the inner surface 41 side toward the end portion on the end surface 42 side, as long as the end portion on the end surface 42 side is formed so as to have the highest height.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wire-wound inductor component comprising:

a core having a columnar shaft portion, and a first support portion and a second support portion that are respectively provided on a first end portion and a second end portion of the shaft portion;

a first terminal electrode and a second terminal electrode provided on the first support portion and the second support portion, respectively;

a wire wound around the shaft portion, and having a first end connected to the first terminal electrode and a second end connected to the second terminal electrode; and a cover member disposed between at least the first support portion and the second support portion, and covering an upper surface of the shaft portion, wherein a distance between an upper surface of the shaft portion and a top surface of the first support portion and the second support portion in a height direction of the core is defined as a top surface step, a distance between a lower surface of the shaft portion and a bottom surface of the first support portion and the second support portion in a height direction of the core is defined as a bottom surface step, the top surface step is smaller than the bottom surface step, the top surface step is larger than a wire diameter of the wire, and a distance between an upper surface of the shaft portion and an uppermost surface of the wire is larger than half of the top surface step.

2. The wire-wound inductor component according to claim 1, wherein an upper surface of the shaft portion has a covered region covered by the wire and an exposed region not covered by the wire, and an area of the covered region is larger than an area of the exposed region.

3. The wire-wound inductor component according to claim 1, wherein the cover member covers a top surface of the first support portion and the second support portion.

4. The wire-wound inductor component according to claim 1, wherein an angle formed by an inner surface on a side of a bottom surface of the first support portion and a bottom surface of the first support portion is smaller than an angle formed by an inner surface on a side of a top surface of the first support portion and a top surface of the first support portion.

5. The wire-wound inductor component according to claim 1, wherein a radius of curvature of a connection surface connecting a lower surface of the shaft portion and an inner surface of the first support portion is smaller than a radius of curvature of a connection surface connecting a side surface of the shaft portion and an inner surface of the first support portion.

6. The wire-wound inductor component according to claim 1, wherein a height dimension of the core is larger than a width dimension of the core, and a difference between the height dimension and the width dimension is within a range from about 30 μm to about 70 μm.

7. The wire-wound inductor component according to claim 1, wherein the top surface step is equal to or less than about 40% of the bottom surface step.

8. The wire-wound inductor component according to claim 7, wherein the top surface step is equal to or more than about 20% of the bottom surface step.

9. The wire-wound inductor component according to claim 1, wherein the top surface step is equal to or less than about 10% of a height dimension of the core.

10. The wire-wound inductor component according to claim 9, wherein the top surface step is equal to or more than about 5% of a height dimension of the core.

11. The wire-wound inductor component according to claim 1, wherein the top surface step is equal to or less than about 15% of a width dimension of the core.

12. The wire-wound inductor component according to claim 11, wherein the top surface step is equal to or more than about 5% of a width dimension of the core.

13. The wire-wound inductor component according to claim 1, wherein a distance between an uppermost surface of the wire and a top surface of the cover member is smaller than a wire diameter of the wire.

14. The wire-wound inductor component according to claim 2, wherein the cover member covers a top surface of the first support portion and the second support portion.

15. The wire-wound inductor component according to claim 2, wherein an angle formed by an inner surface on a side of a bottom surface of the first support portion and a bottom surface of the first support portion is smaller than an angle formed by an inner surface on a side of a top surface of the first support portion and a top surface of the first support portion.

16. The wire-wound inductor component according to claim 2, wherein a radius of curvature of a connection surface connecting a lower surface of the shaft portion and an inner surface of the first support portion is smaller than a radius of curvature of a connection surface connecting a side surface of the shaft portion and an inner surface of the first support portion.

17. The wire-wound inductor component according to claim 2, wherein a height dimension of the core is larger than a width dimension of the core, and a difference between the height dimension and the width dimension is within a range from about 30 μm to about 70 μm.

18. The wire-wound inductor component according to claim 2, wherein the top surface step is equal to or less than about 40% of the bottom surface step.

19. The wire-wound inductor component according to claim 2, wherein the top surface step is equal to or less than about 10% of a height dimension of the core.

20. The wire-wound inductor component according to claim 2, wherein the top surface step is equal to or less than about 15% of a width dimension of the core.

21. The wire-wound inductor component according to claim 1, wherein the cover member directly contacts the upper surface of the shaft portion and the wire.

22. The wire-wound inductor component according to claim 1, wherein the cover member extends around an entire periphery of an upper portion of at least one of the first support portion and the second support portion.

* * * * *